US009985330B2

(12) United States Patent
Park et al.

(10) Patent No.: US 9,985,330 B2
(45) Date of Patent: May 29, 2018

(54) RADIO FREQUENCY FILTER WITH CAVITY STRUCTURE

(71) Applicant: KMW Inc., Hwaseong, Gyeonggi-Do (KR)

(72) Inventors: Nam-Shin Park, Gyeonggi-Do (KR); Joung-Hoe Kim, Gyeonggi-Do (KP)

(73) Assignee: KMW INC., Hwaseong, Gyeonggi-do (KR)

( * ) Notice: Subject to any disclaimer, the term of this patent is extended or adjusted under 35 U.S.C. 154(b) by 77 days.

(21) Appl. No.: 15/072,898

(22) Filed: Mar. 17, 2016

(65) Prior Publication Data

US 2016/0204493 A1 Jul. 14, 2016

Related U.S. Application Data

(63) Continuation of application No. PCT/KR2015/010654, filed on Oct. 8, 2015.

(30) Foreign Application Priority Data

Oct. 28, 2014 (KR) ..... 10-2014-0147612

(51) Int. Cl.
*H01P 1/205* (2006.01)
*H01P 7/04* (2006.01)
(Continued)

(52) U.S. Cl.
CPC ..... *H01P 1/2053* (2013.01); *H01P 1/20* (2013.01); *H01P 1/202* (2013.01); *H01P 1/208* (2013.01); *H01P 1/30* (2013.01); *H01P 7/04* (2013.01)

(58) Field of Classification Search
CPC .... H01P 1/202; H01P 7/04; H01P 1/30; H01P 1/2053; H01P 1/205
(Continued)

(56) References Cited

U.S. PATENT DOCUMENTS 3,873,949 A 3/1975 Dorsi et al.
4,156,860 A 5/1979 Atia et al.
(Continued)

FOREIGN PATENT DOCUMENTS

JP 48-076839 U1 9/1973
JP H05-235620 A 9/1993
(Continued)

OTHER PUBLICATIONS

NPL Reference http://www.engineeringtoolbox.com/thermal-expansion-metals-d_859. html; Aug. 8, 2017.*
Decision on Grant dated Oct. 4, 2016 in corresponding Korean Patent Application No. 10-2014-0147612.
(Continued)

*Primary Examiner* — Rakesh Patel
(74) *Attorney, Agent, or Firm* — Mintz Levin Cohn Ferris Glovsky and Popeo, P.C.; Kongsik Kim

(57) ABSTRACT

A radio frequency filter with a cavity structure is provided. The radio frequency filter includes a housing having an inner hollow portion to have a cavity and open from one side of the housing, a cover sealing the open side of the housing, and a resonant element disposed inside the hollow housing. A through hole is formed at a part of the cover, corresponding to the resonant element, and a tuning element is installed covering the through hole, for frequency tuning. The tuning element is formed of a material having a different thermal expansion coefficient from a thermal expansion coefficient of a material of the cover.

8 Claims, 6 Drawing Sheets

(51) Int. Cl.

| | |
|---|---|
| ***H01P 1/30*** | (2006.01) |
| ***H01P 1/202*** | (2006.01) |
| ***H01P 1/20*** | (2006.01) |
| ***H01P 1/208*** | (2006.01) |

(58) Field of Classification Search
USPC ..... 333/202, 203, 207–209, 223, 229
See application file for complete search history.

(56) References Cited

U.S. PATENT DOCUMENTS

| | | | | |
|---|---|---|---|---|
| 4,620,165 | A * | 10/1986 | Kinzler | H01R 13/719 333/167 |
| 6,057,748 | A * | 5/2000 | Hsing | H01P 7/04 333/224 |
| 7,449,981 | B2 * | 11/2008 | Park | H01P 1/205 333/203 |

FOREIGN PATENT DOCUMENTS

| | | | |
|---|---|---|---|
| JP | 2005341491 | A | 12/2005 |
| KR | 10-2004-0100084 | A | 12/2004 |
| KR | 2013-0098205 | A | 9/2013 |
| KR | 10-2014-0013451 | A | 2/2014 |
| KR | 10-2014-0026235 | A | 3/2014 |
| KR | 20-2014-0004340 | U | 7/2014 |

OTHER PUBLICATIONS

Yao, Hui-Wen et al. "Temperature Characteristics of Combline Resonators and Filters." IEEE MTT-S Digest, 2001, pp. 1475-1478.

* cited by examiner

RADIO FREQUENCY FILTER WITH CAVITY STRUCTURE

CROSS REFERENCE TO RELATED APPLICATIONS

This application is a continuation of International Application No. PCT/KR2015/010654 filed on Oct. 8, 2015, which claims priority to Korean Application No. 10-2014-0147612 filed on Oct. 28, 2014, which applications are incorporated herein by reference.

BACKGROUND

Technical Field

The present disclosure relates to an apparatus for processing a wireless signal, for use in a wireless communication system, and more particularly, to a radio frequency filter with a cavity structure, such as a cavity filter.

Description of the Related Art

A radio frequency filter with a cavity structure generally includes a plurality of rectangular accommodating spaces, that is, cavities in a metal housing, with a resonant element such as a dielectric resonant (DR) element or a metal resonant rod accommodated in each cavity, to thereby generate ultra-high frequency resonance. In the radio frequency filter with this cavity structure, a cover may be provided on the cavity structure to cover the cavities, and a tuning structure with a plurality of tuning screws and nuts for fastening the screws may be installed on the cover in order to tune filtering characteristics of the radio frequency filter. An exemplary radio frequency filter with a cavity structure is disclosed in Korea Laid-Open Patent Publication No. 10-2004-100084 (entitled 'Radio Frequency Filter', publicized on Dec. 2, 2004, and invented by PARK Jong Gyu, et. al.) filed by the present applicant.

The radio frequency filter with a cavity structure is used to process a transmission/received wireless signal in a wireless communication system, particularly in a base station or a relay in a mobile communication system.

Meanwhile, Korea Laid-Open Patent Publication No. 10-2014-0026235 (entitled 'Radio Frequency Filter with Cavity Structure', publicized on Mar. 5, 2014, and invented by PARK Nam Sin, et. al.) filed by the present applicant discloses a simplified filter structure for enabling frequency tuning without using a coupling structure of tuning screws and fastening nuts. The document proposes a technology of forming one or more sunken portions at positions corresponding to resonant elements on a cover in the process of fabricating the cover using a plate of a base material such as aluminum or magnesium (including an alloy) by pressing or die casting. Also, a plurality of dot peens are formed in the sunken portions by marking or pressing the cover using a marking pin of an external marking equipment. These sunken portions and dot peens substitute for the coupling structure of tuning screws and fastening nuts, which is generally used for frequency tuning, and enable appropriate tuning by reducing the distance between the sunken portions (and the dot peens) and the resonant elements.

The technology disclosed in Korea Laid-Open Patent Publication No. 10-2014-0026235 is suitable for a small, lightweight filter structure because it does not adopt the general coupling structure of tuning screws and fastening nuts. According to the technology disclosed in Korea Laid-Open Patent Publication No. 10-2014-0026235, however, the sunken portions should be formed on the cover by die casting, when a relatively large filter is fabricated. As a result, process cost may be increased.

Moreover, the cover and a housing are fabricated of a lightweight material such as aluminum (including an alloy) in consideration of strength, weight, fabrication cost, and task easiness in the technology disclosed in Korea Laid-Open Patent Publication No. 10-2014-0026235. Due to a large thermal expansion coefficient of aluminum, a change in ambient temperature and heat emission of the product cause a change in the characteristics of the filter.

More specifically, an antenna device with a filter is generally used in a use environment of constant temperature and high temperature and affected by heat emitted from other parts (for example, an amplifier). Especially if a cavity filter is used as a high-power transmission filter, a large amount of heat is produced in view of insertion loss. If ambient temperature is changed, the housing and resonator of the cavity filter causes thermal contraction and expansion. As capacitance and inductance are changed due to a change in the distances between components and thus unique characteristics of the filter are changed, operation malfunction may occur. This problem becomes serious in a resonator structure using a metal resonant rod.

In this context, various techniques have been studied and adopted in order to minimize temperature change-incurred characteristic changes in the resonator structure of a conventional cavity filter, particularly a structure using a metal resonant rod. For example, the resonant rod is basically formed of a material having a very small thermal expansion coefficient such as Invar, or each resonant element has a lower part formed of the same material as the housing (for example, aluminum) and an upper part formed of a different material from that of the lower part, such as Bs, Sum, Cu, or the like. However, it is difficult to compensate the temperature of the radio frequency filter because of the limitations (price and thermal expansion coefficient) of a material applied to the resonant rods of the cavity filter.

The contents described as the related art have been provided merely for assisting in the understanding for the background of the present invention and should not be considered as corresponding to the related art known to those skilled in the art.

SUMMARY

Accordingly, an object of the present disclosure is to provide a radio frequency filter with a cavity structure, for enabling frequency tuning without using a coupling structure of tuning screws and fastening nuts, and even when a relatively large filter is fabricated, facilitating simple fabrication with low cost.

Another object of the present disclosure is to provide a radio frequency filter with a cavity structure, which can stably compensate for a change in filtering characteristics, caused by a temperature change, and which can be fabricated with relatively low cost.

The object of the present disclosure can be achieved by providing a radio frequency filter with a cavity structure. The radio frequency filter includes a housing having an inner hollow portion to have a cavity and open from one side of the housing, a cover sealing the open side of the housing, and a resonant element disposed inside the hollow housing. A through hole is formed at a part of the cover, corresponding to the resonant element, and a tuning element is installed covering the through hole, for frequency tuning. The tuning element is formed of a material having a different thermal expansion coefficient from a thermal expansion coefficient of a material of the cover.

The material of the tuning element may have a lower thermal expansion coefficient than the thermal expansion coefficient of the material of the cover.

BRIEF DESCRIPTION OF DRAWINGS

The above and other objects, features and other advantages of the present invention will be more clearly understood from the following detailed description when taken in conjunction with the accompanying drawings.

DETAILED DESCRIPTION

Reference will now be made in detail to the preferred embodiments of the present disclosure. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Figure 1:
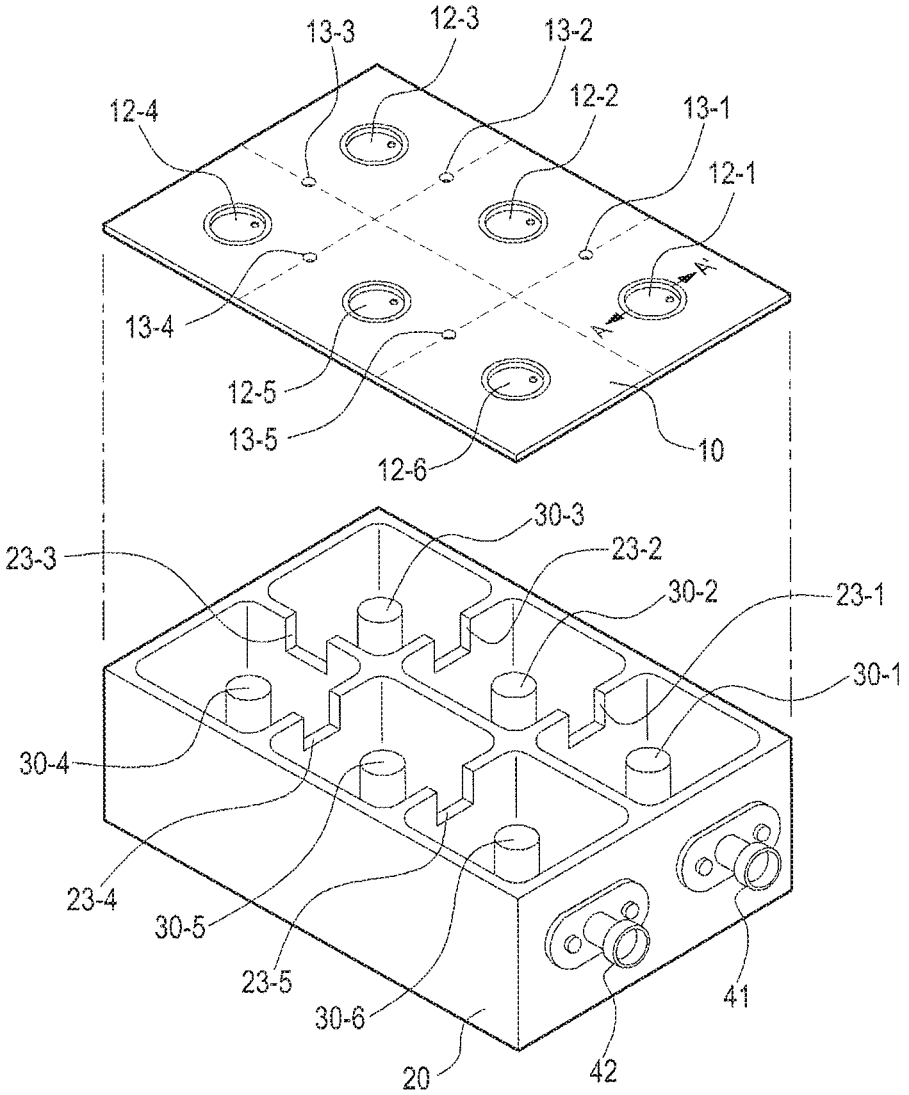
FIG. 1 is an exemplary partial exploded perspective view illustrating a radio frequency filter with a cavity structure according to an exemplary embodiment of the present disclosure.
Figure 2:
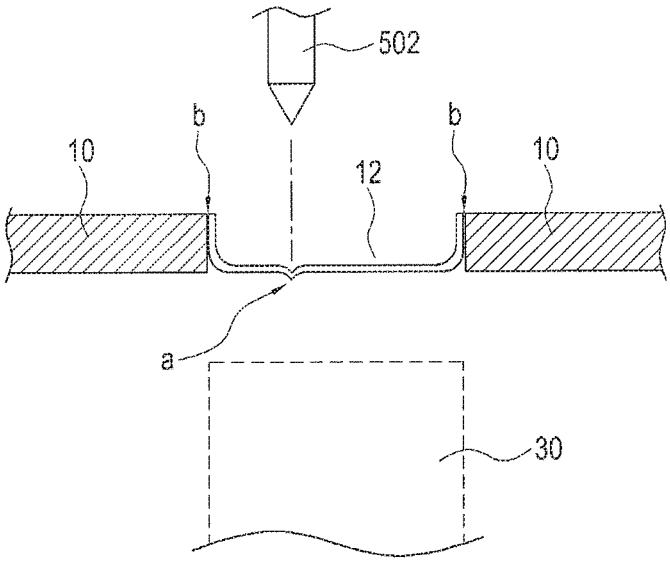
FIG. 2 is an exemplary sectional view of a cover illustrated in FIG. 1, taken along line A-A'.
Figure 3:
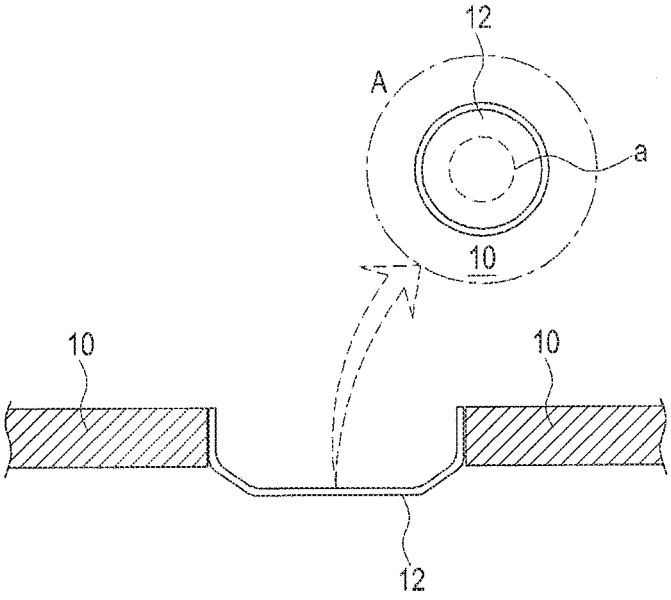
FIG. 3 illustrates dot peens formed in a tuning element illustrated in FIG. 2.

FIG. 1 is a partial exploded perspective view illustrating a radio frequency filter with a cavity structure according to an embodiment of the present disclosure, FIG. 2 is a sectional view of a cover illustrated in FIG. 1, taken along line A-A', and FIG. 3 illustrates dot peens are formed in a tuning element illustrated in FIG. 2. Referring to FIGS. 1, 2 and 3, similarly to a conventional radio frequency filter, the radio frequency filter with a cavity structure according to the embodiment of the present disclosure includes a container having at least one cavity which is hollow and isolated from the outside. The container includes a housing 20 open from one side (for example, a top side), in which cavities are formed, and a cover 10 sealing the opened side of the housing 20.

In the example of FIGS. 1, 2 and 3, for example, six cavities are interconnected in multiple stages inside the housing 20. That is, the six cavities are formed in two rows, each row having three cavities, and thus it may be said that the cavities are sequentially connected in circuit. The hollow spaces of the housing 20, that is, the cavities have resonant elements 30 (30-1, 30-2, 30-3, 30-4, 30-4, 30-5, and 30-5) generally at their centers. Also, to build sequential coupling structures in the cavities of the housing 20, coupling windows 23 (23-1, 23-2, 23-3, 23-4, and 23-5) are formed as connection paths between the cavities that are sequentially connected. These coupling windows 23 may be formed by removing predetermined parts of a predetermined size in walls between the cavities. Further, an input terminal 41 and an output terminal 42 of the radio frequency filter may be attached through holes (not shown) that may be formed on one side surface of the housing 20 so that the input terminal 41 and the output terminal 42 may be connected to an input-end cavity and an output-end cavity, respectively in FIG. 1.

In the above-described configuration, the housing 20, the cavities formed in the housing 20, and the resonant elements 30 may be configured similarly to their conventional counterparts in the radio frequency filter according to the embodiment of the present disclosure. All of the housing 20 and the resonant elements 30 may be formed of aluminum (or an aluminum alloy). The cover 10 according to the embodiment of the present disclosure may also be formed of the same material as the housing 20, that is, aluminum (or aluminum alloy), like a conventional cover.

In contrast, through holes are formed in a predetermined size and shape (circle in the example of FIGS. 1, 2 and 3) at positions corresponding to the resonant elements 30 of the cavities of the housing 20, on the cover 10 according to the embodiment of the present disclosure. Further, metal tuning elements 12 (12-1, 12-2, 12-3, 12-4, 12-5, and 12-6) each being shaped into a cup in a predetermined size are fit into the through holes, covering areas defined by the through holes.

The bottom surfaces of the tuning elements 12 are relatively flat, facing the resonant elements 30. As illustrated more clearly in FIGS. 2 and 3, the side surfaces of the tuning elements 12 closely contact the side surfaces b of the through holes of the cover 10. Herein, the tuning elements 12 may be pressedly fit into the through holes of the cover 10 by forced insertion. Or the tuning elements 12 may be fixedly installed in the through holes by lead soldering, laser soldering, or high-frequency induced heating. The tuning elements 12 are formed of a material having a different thermal expansion coefficient from that of the cover 10. For example, the tuning elements 12 may be formed of a material having a lower thermal expansion coefficient than that of the cover 10. If the cover 10 is formed of aluminum, the metal cups 12 may be formed of copper (or a copper alloy) or iron (or an iron alloy). To facilitate soldering, the tuning elements 12 may be plated with silver.

The through holes of the cover 10 and the tuning elements 12 attached in the through holes are used to substitute for a conventional coupling structure of tuning screws and fastening buts. In an embodiment of the present disclosure, at least one (generally, a plurality of) dot peen a is formed in each tuning element 12 through the through holes 10 by means of an external marking equipment (5 in FIG. 4) so that the distances between the tuning elements 12 (the bottoms of the tuning elements 12) and the top ends of the resonant elements 30 may be decreased (in addition, capacitance values between the tuning elements 12 and the resonant elements 30 of the housing 20 may be increased by changing the volume of the inner hollow portion) during monitoring of filtering characteristics in case of frequency tuning, until the filtering characteristics are optimized or satisfy reference values. One dot peen a is shown in FIG. 2 as formed by marking or pressing of the marking pin (502 in FIG. 2) of the external marking equipment, by way of example.

FIG. 3 illustrates dot peens formed in a tuning element 12 illustrated in FIG. 2, for example, a state of completed frequency tuning. Referring to FIG. 3, a plurality of circular dot peens a may be formed in the tuning element 12 by means of, for example, the external marking equipment, as denoted by a one-dotted circle A showing the plan view of the dot peens a during the frequency tuning. Upon completion of the frequency tuning, a part (for example, the center) of the bottom surface of each tuning element 12 is pushed down and thus, for example, a U-shaped concave portion is formed on the bottom surface of the tuning element 12. As a result, the distances between the top ends of the resonant elements 30 and the tuning elements 12 are reduced, relative to their initial installation.

Figure 4:
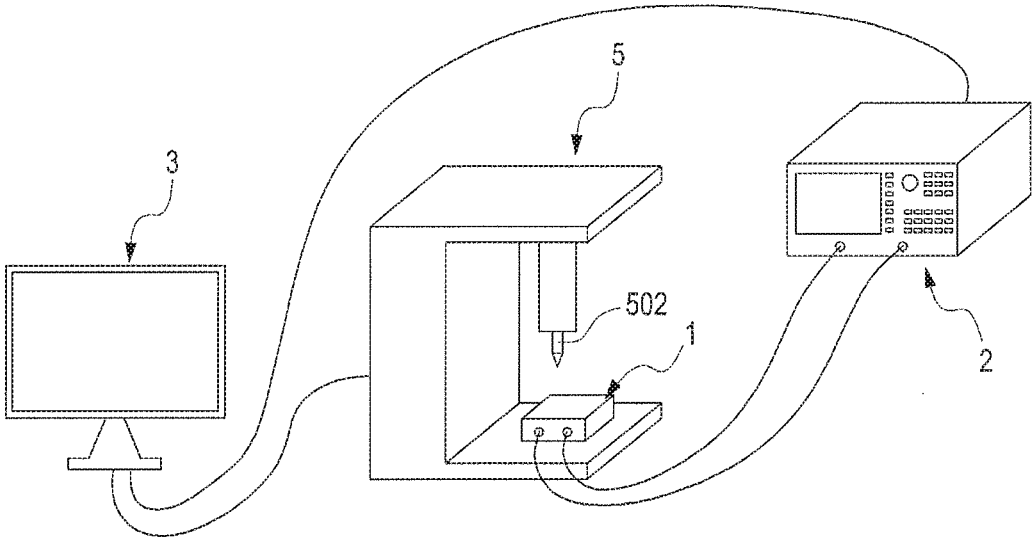
FIG. 4 illustrates an exemplary configuration of a frequency tuning device in the radio frequency filter illustrated in FIG. 1.

With reference to FIG. 4, an overall configuration of a frequency tuning device will be described. The radio frequency filter 1 according to the embodiment of the present disclosure is placed on a shelf of a marking equipment 5 with the marking pin 502. The marking equipment 5 may be a general dot peen marking machine. A measuring equipment 2 measures operation characteristics of the radio frequency filter 1. For this purpose, the measuring equipment 2 is connected to the radio frequency filter in order to provide an input signal of a predetermined frequency to the radio frequency filter 1 and receive an output in relation to the input from the radio frequency filter 1. The operation characteristics of the radio frequency filter 1 measured by the measuring equipment 2 is provided to a control equipment 3 that may be configured with a personal computer (PC). The control equipment 3 forms an appropriate number of dot peens a in an appropriate shape on the metal plates 12 through the through holes of the cover 10 of the radio frequency filter 1 by controlling the marking equipment 5 until filtering characteristics are optimized or satisfy reference values, while monitoring the operation characteristics of the radio frequency filter 1.

A plurality of circular dot peens a may be formed on the bottom of each tuning element 12 in a circular through hole. Also, the material, thickness, size, and the like of the tuning element 12 is appropriately set so that unintended deformation may not occur to the tuning element 12 despite stress during frequency tuning involving forming the dot peens a. In this case, the tuning elements 12 may be formed of, for example, copper having a high elongation percentage, to thereby facilitate formation of the dot peens a.

Even though the same marking equipment 5 is used, very different dot peens a may be formed depending on the size, thickness, or shape of the tuning elements 12. The tuning elements 12 may be appropriately designed according to properties or conditions required for the radio frequency filter 1. For example, if the thickness of the cover 10 is set to about 2.5 T(mm) to 3 T(mm), the thickness of the tuning elements 12 may be set to about 0.2 T(mm) to 0.3 T(mm).

As described above, the radio frequency filter with a cavity structure according to the embodiment of the present disclosure is provided with a frequency tuning structure in which the cover 10 is formed in the form of a plate on the whole, through holes penetrate through the cover 10, and tuning elements are installed in the through holes. Therefore, compared to the conventional radio frequency filter using a coupling structure of tuning screws and fastening nuts, the radio frequency filter with a cavity structure according to the embodiment of the present disclosure has a simplified structure, can be fabricated fast with low cost, and can be made smaller and more lightweight.

According to the technology disclosed in Korea Laid-Open Patent Publication No. 10-2014-0026235, in order to fabricate a structure corresponding to the structure with the cover 10 and the tuning elements 12 according to the embodiment of the present disclosure, particularly when a relatively large filter is fabricated, grooves of an appropriate size should be formed by cutting corresponding parts of a metal cover through lathe work. The lathe work is relatively complex and takes a lot of time. Also, it may be difficult to maintain the thickness of groove parts to be constant. Compared to the conventional technology, the operation of forming through holes in a cover and attaching the above-described tuning elements in the holes may be relatively simple and fast in the present disclosure. As stated before, the tuning elements 12 may be formed of a material having a different thermal expansion coefficient from (for example, lower than) that of the cover 10. This property is very significant because it enables the cavity filter 1 of the present disclosure to compensate for a change of a resonant frequency with respect to a temperature change, along with the shape of the tuning elements 12.

Figure 5:
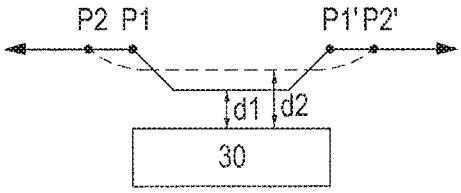
FIG. 5 is an exemplary view illustrating a simulated distance change between a tuning element and a resonant element, caused by a temperature change.

With reference to FIG. 5, a function for compensating for a change of a resonant frequency caused by a temperature change, executed by the tuning elements 12 will be described in detail. In FIG. 5, a solid line P1-P1' represents the state of a tuning element for which frequency tuning has been completed, and a dotted line P2-P2' represents a changed state of the tuning element 12, caused by a temperature rise.

If temperature rises, the sizes of the housing 20 and the cover 10 in the filter increase on the whole. As a result, the cavities also become larger, thus shifting an entire resonant frequency band to a lower frequency band. Since the tuning elements 12 are formed of a material having a thermal expansion coefficient lower than that of the cover 10, as the cover 10 becomes larger, the tuning elements 12 are extended in an arrowed direction and deformed to a state indicated by the dotted line in FIG. 5. Therefore, a distance d2 between the tuning elements 12 and the resonant elements 30 after the temperature rise is larger than a distance d1 between the tuning elements 12 and the resonant elements 30 before the temperature rise. With the change of the distance between the tuning elements 12 and the resonant elements 30, the capacitance between the tuning elements 12 and the resonant elements 30 decreases and the total resonant frequency band is shifted to a higher frequency band. That is, the distance change between the tuning elements 12 and the resonant elements 30 caused by the temperature rise functions to compensate for a change of the resonant frequency caused by the temperature rise of the cover 10 and the housing 20. If temperature drops, the tuning elements 12 get closer to the resonant elements 30, thus compensating for a resonant frequency change caused by the temperature change.

As described before with reference to FIG. 5, since the tuning elements 12 formed of a different metal having a lower thermal expansion coefficient than that of the cover 10 are installed on the cover 10 over the resonant elements 30 and the distance between the tuning elements 12 and the resonant elements 30 is increased or decreased at a temperature change, the capacitance between the cover 10 and the resonant elements 30 is controlled in the radio frequency filter 1 according to the embodiment of the present disclosure. Thus, a resonant frequency change attributed to a change in the size of the housing 20 caused by a temperature change may be compensated for.

Meanwhile, coupling tuning screw holes 13 (13-1, 13-2, 13-3, 13-4, and 13-5) may be formed at positions corresponding to the coupling windows 23 being connection paths between the cavities, to be engaged with coupling tuning screws (not shown) in the housing 20. Coupling tuning may also be performed by inserting the coupling tuning screws (not shown) for coupling tuning into the coupling tuning screw holes 13 to an appropriate depth. Herein, the coupling tuning screws may be fixed at appropriate positions by an additional adhesive such as epoxy resin.

Further, conductive pin insertion holes of a very fine size may be formed in the tuning elements 12. Conductive pins are inserted in the conductive pin insertion holes in order to short-circuit the resonant elements 30 of the housing 20 with the tuning elements 12 during frequency tuning. More specifically, frequency tuning may be performed sequentially for the individual resonant elements 30 in the cavities according to a frequency tuning scheme. In this case, the resonant elements 30 of the remaining cavities other than a cavity subjected to current tuning need to be electrically short-circuited. Then, a conductive pin may be inserted into a conductive pin insertion hole formed in each tuning element 12, thus short-circuiting the resonant element 30 of a cavity corresponding to the tuning element 12.

Figure 6:
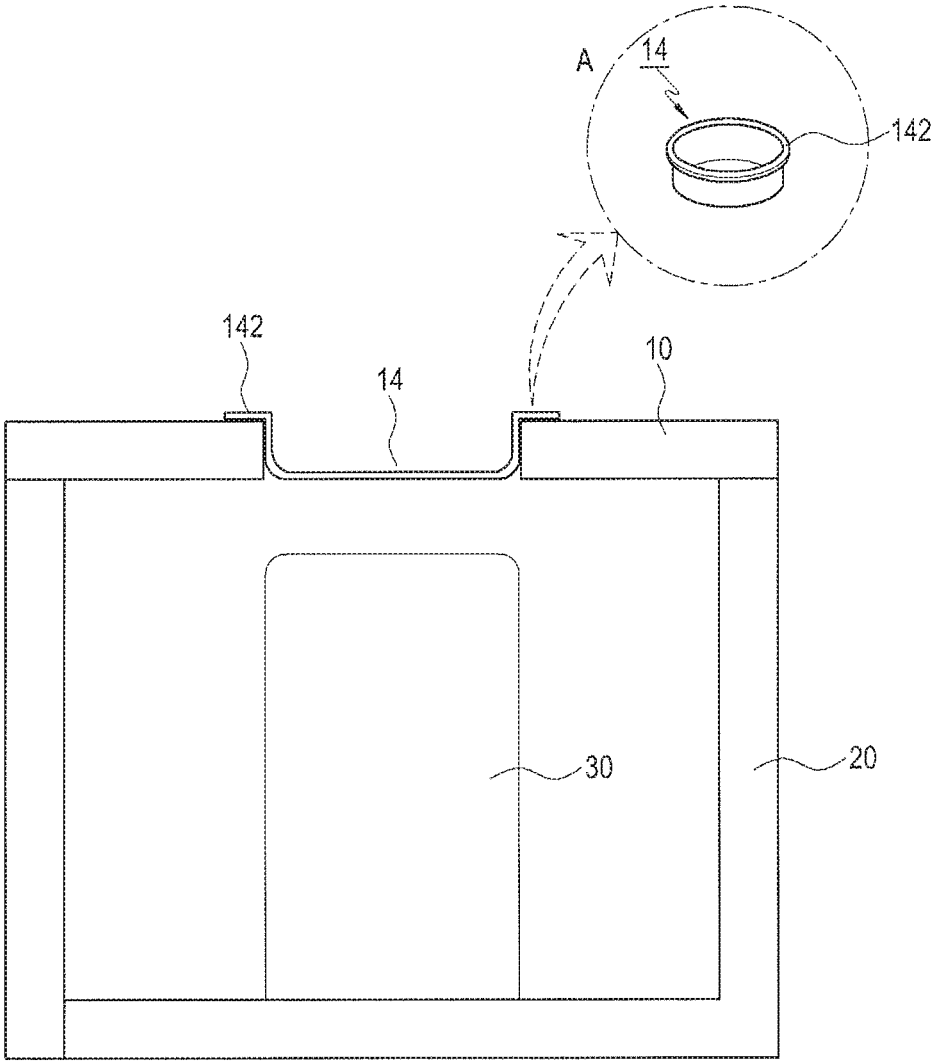
FIG. 6 illustrates the configuration of a radio frequency filter with a cavity structure according to an exemplary embodiment of the present disclosure.

FIG. 6 illustrates the configuration of a radio frequency filter with a cavity structure according to another embodiment of the present disclosure. In the example of FIG. 6, a filter having one cavity is shown. In the second embodiment illustrated in FIG. 6, the cover 10, the housing 20, and a resonant element 30 may be formed of the same materials as in the first embodiment and have similar structures to in the first embodiment. However, a tuning element 14 according to the second embodiment illustrated in FIG. 6 has a modified structure, compared to the tuning elements 12 in the first embodiment. That is, as shown in a perspective view of the tuning element 14 in a one-dotted circle A, the cup-shaped tuning element 14 includes a catching member 142 extended outward from the top end of the cup. The catching member 142 contacts an area around a through hole on the cover 10 and is attached to the area by soldering, thereby increasing fixedness of the tuning element 14.

Figure 7:
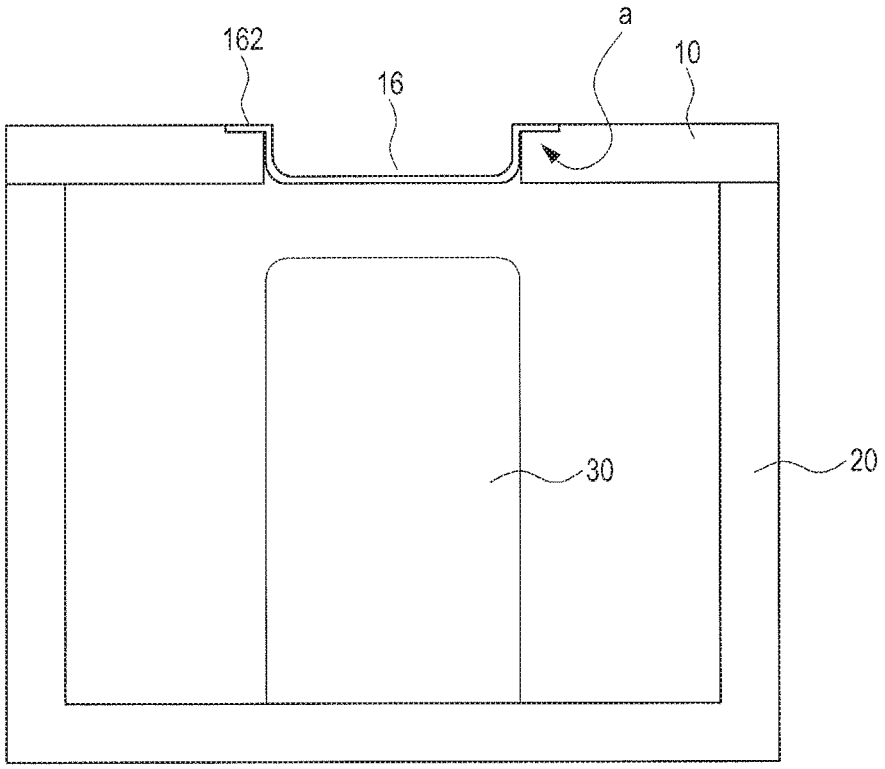
FIG. 7 illustrates the configuration of a radio frequency filter with a cavity structure according to an exemplary embodiment of the present disclosure.

FIG. 7 illustrates the configuration of a radio frequency filter with a cavity structure according to a third embodiment of the present disclosure. The filter shown in the example of FIG. 7 has a very similar structure as the filter according to the second embodiment illustrated in FIG. 6. Particularly, a cup-shaped tuning element 16 according to the third embodiment illustrated in FIG. 7 has a catching member 162 on the top end of the tuning element 16, like the tuning element illustrated in FIG. 6. In the third embodiment illustrated in FIG. 7, a groove a is formed by cutting an area around a through hole on the cover 10 in correspondence with the thickness of the catching member 162 of the tuning element 16. This structure fixes the tuning element 16 more stably.

Figure 8:
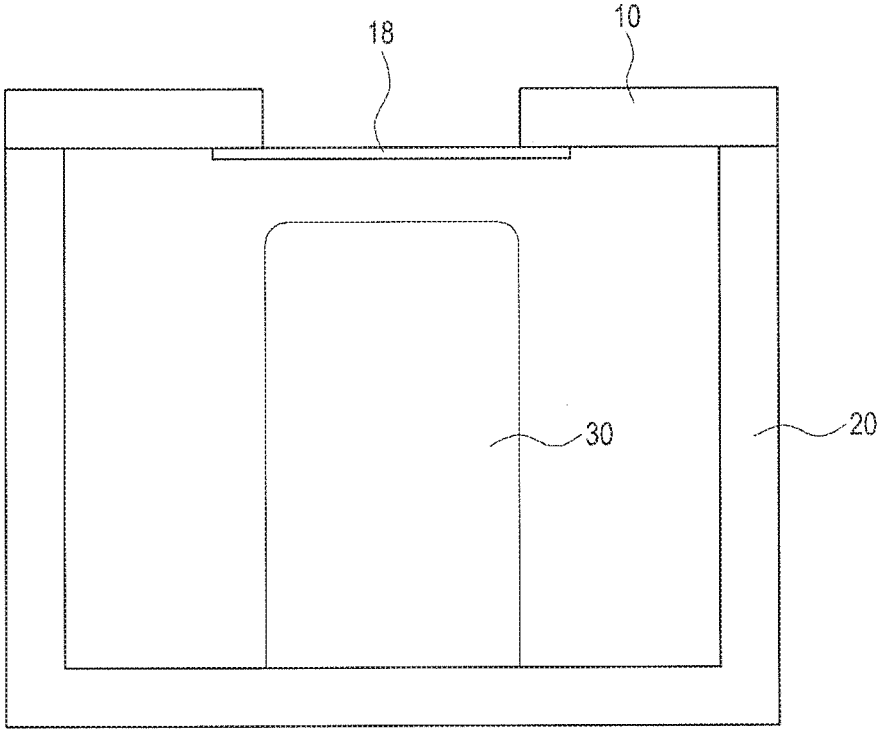
FIG. 8 illustrates the configuration of a radio frequency filter with a cavity structure according to an exemplary embodiment of the present disclosure.

FIG. 8 illustrates the configuration of a radio frequency filter with a cavity structure according to a fourth embodiment of the present disclosure. As in the embodiments illustrated in FIGS. 6 and 7, a filter having one cavity is shown in the example of FIG. 8. In the fourth embodiment illustrated in FIG. 8, the cover 10, the housing 20, and the resonant element 30 are formed of the same materials as and have similar structures to in the second and third embodiments. However, a tuning element 18 according to the fourth embodiment illustrated in FIG. 8 is a thin metal plate, compared to the foregoing embodiments.

The tuning element 18 shaped into a thin metal plate is attached onto the bottom surface of the cover 10 by covering an area formed by a corresponding through hole through soldering. As in the other embodiments, the tuning element 18 may be formed of copper. Subsequently, a concave portion is formed in the tuning element 18 by means of a marking equipment.

A radio frequency filter with a cavity structure according to embodiments of the present disclosure may be configured as described above. However, many other embodiments or modification examples may be implemented in the present disclosure. For example, while it has been described above by way of example that a tuning element is formed of a material having a lower thermal expansion coefficient than that of a cover, the tuning element may be formed of a material having a higher thermal expansion coefficient than that of the cover in another embodiment of the present disclosure. In that case, for example, when temperature rises, an entire resonant frequency band may be shifted to a higher frequency band due to different materials of a housing and resonant elements and thus different thermal expansion of the resonant elements from the housing in another embodiment of the present disclosure. Then, to compensate temperature, that is, to shift the entire resonant frequency band to a lower frequency band, the tuning element may be formed of a material having a higher thermal expansion coefficient than that of the cover.

Also, the number and shape of through holes in each cavity and the number and shape of tuning elements installed in the through holes may vary, not being limited to the foregoing embodiments. Besides, a different number of through holes having a different shape may be formed for each cavity.

In the above description, the resonant elements may be fabricated separately from the housing and attached in the housing. Also, since the housing and the resonant elements may be formed of the same material, the housing and the resonant elements may be integrally fabricated by die casting in the present disclosure. Or as disclosed in Korea Laid-open patent Publication No. 10-2014-0026235, the housing and the resonant elements inside the housing may be integrally formed by pressing.

It may be further contemplated as another embodiment that the through holes formed on the cover are tapered, with a diameter decreasing from the top to the bottom and the tuning elements are shaped into cups with a diameter decreasing from the top to the bottom. This structure may be more stable during frequency tuning.

As described above, the radio frequency filter with a cavity structure according to the present disclosure is so configured as to enable frequency tuning without using a general coupling structure of tuning screws and fastening nuts. Even though the radio frequency filter is relatively large, the radio frequency filter can be fabricated in a simple process with low cost and have a lightweight structure.

Particularly, the radio frequency filter with a cavity structure according to the present disclosure can stably compensate for a change in filtering characteristics, caused by a temperature change, without using conventional resonant rods formed of a material such as Invar, and can be fabricated with low cost. Furthermore, when the present disclosure is applied, resonant rods can be designed more freely, for example, the resonant rods can be fabricated integrally with an aluminum filter housing during fabrication of the housing.

It will be apparent to those skilled in the art that various modifications and variations can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. A radio frequency filter with a cavity structure, comprising:

a housing having an inner hollow portion to have a cavity and open from one side of the housing;

a cover sealing the open side of the housing; and a resonant element disposed inside the inner hollow portion of the housing, wherein a through hole is formed at a part of the cover, corresponding to the resonant element, and a tuning element is installed covering the through hole, for frequency tuning, wherein the tuning element is formed of a material having a different thermal expansion coefficient from a thermal expansion coefficient of a material of the cover, and wherein a plurality of dot peens are formed on a bottom surface of the tuning element using an external marking equipment.

2. The radio frequency filter according to claim 1, wherein the tuning element is shaped into a cup.

3. The radio frequency filter according to claim 2, wherein a catching member contacting an area around the through hole is formed on a top end of the tuning element shaped into a cup on the cover.

4. The radio frequency filter according to claim 3, wherein a groove is formed in the area around the through hole of the cover, in correspondence with the catching member of the tuning element.

5. The radio frequency filter according to claim 1, wherein the tuning element is shaped into a metal plate.

6. The radio frequency filter according to claim 1, wherein the thermal expansion coefficient of the tuning element is lower than the thermal expansion coefficient of the cover.

7. The radio frequency filter according to claim 1, wherein the tuning element is formed of copper.

8. The radio frequency filter according to claim 1, wherein when the plurality of dot peens are formed on the bottom surface of the tuning element using the external marking equipment, a concave portion is formed on the bottom surface of the tuning element.

* * * * *